US008439415B2

(12) United States Patent
Valaas

(10) Patent No.: US 8,439,415 B2
(45) Date of Patent: May 14, 2013

(54) SKI BOOT CARRIER

(76) Inventor: Laura Aubrey Valaas, Wenatchee, WA (US)

( * ) Notice: Subject to any disclaimer, the term of this patent is extended or adjusted under 35 U.S.C. 154(b) by 204 days.

(21) Appl. No.: 12/927,937

(22) Filed: Nov. 30, 2010

(65) Prior Publication Data

US 2012/0132681 A1 May 31, 2012

(51) Int. Cl.
*A45F 5/00* (2006.01)

(52) U.S. Cl.
USPC ..... 294/145; 294/146; 211/113; 211/34; 12/120.5; 36/117.1; 36/132

(58) Field of Classification Search ..... 294/137, 294/145–147, 158–160, 162–163, 165, 169–170, 294/142–143; 211/113, 85.3, 34, 38, 35, 211/85.6; 12/120.5; 36/117.1, 117.3, 117.4, 36/132; 224/250, 255
See application file for complete search history.

(56) References Cited

U.S. PATENT DOCUMENTS

| | | | | |
|---|---|---|---|---|
| 2,603,393 | A | 7/1952 | Oblusteel | |
| 2,963,165 | A | 12/1960 | Steiner | |
| 3,301,369 | A | 1/1967 | Karn, Jr. | |
| 3,370,766 | A | 2/1968 | Woolworth | |
| 3,397,416 | A * | 8/1968 | Celli | 12/120.5 |
| 3,425,567 | A | 2/1969 | Murray | |
| 3,497,891 | A | 3/1970 | Voster et al. | |
| 3,570,681 | A | 3/1971 | Kinshofer | |
| 3,600,734 | A | 8/1971 | Pollinger | |
| 3,608,795 | A | 9/1971 | Klein et al. | |
| 3,653,565 | A | 4/1972 | McAusland | |
| 3,721,373 | A | 3/1973 | Penniman | |
| 3,722,652 | A | 3/1973 | Busch et al. | |
| 3,731,348 | A | 5/1973 | Luehne | |
| 3,775,794 | A | 12/1973 | Fisher | |
| 3,794,226 | A | 2/1974 | Penniman | |
| 3,826,022 | A | 7/1974 | Grzech | |
| 3,826,378 | A | 7/1974 | Novak | |
| 3,841,648 | A | 10/1974 | Meyer | |
| 3,965,586 | A | 6/1976 | Roosli | |

(Continued)

FOREIGN PATENT DOCUMENTS

WO WO 2012/008988 1/2012

OTHER PUBLICATIONS http://www.skitraxx.com, 2012.

(Continued)

*Primary Examiner* — Dean Kramer
*Assistant Examiner* — Stephen Vu

(57) ABSTRACT

A reusable, hand-held carrier for transporting and storing a pair of ski boots includes: (a) a handle portion; (b) a shank including two opposite longitudinal first sides, an upper shank end being attached to a base handle section of the handle portion; (c) a hanger portion extending from a lower shank end and including at least two elongate hook elements, each of the hook elements including an open topped channel and a set of corresponding shoulder portions on opposite walls of the channel that form a pinched zone at the top of the channel. The boot carrier preferably also includes at least one carrier pin for holding a sole guard ski boot accessory within a recess in the carrier shank. A carrier wall mount and boot carrier set is also contemplated. This simplified abstract is not intended to limit, and should not be interpreted as limiting, the scope of the claims.

20 Claims, 7 Drawing Sheets

U.S. PATENT DOCUMENTS

| | | | | |
|---|---|---|---|---|
| 3,999,773 | A | | 12/1976 | Shuttleworth |
| 4,000,909 | A | | 1/1977 | Coale |
| 4,033,460 | A | | 7/1977 | Alexandre |
| D245,892 | S | | 9/1977 | Yocum |
| 4,047,726 | A | | 9/1977 | Kokeisl |
| 4,055,005 | A | | 10/1977 | Meinhart |
| 4,062,453 | A | | 12/1977 | Gorlach |
| D247,415 | S | | 3/1978 | Harper |
| 4,084,867 | A | | 4/1978 | Putt et al. |
| 4,126,255 | A | | 11/1978 | Olson |
| 4,129,312 | A | | 12/1978 | Loffelholz |
| 4,145,062 | A | | 3/1979 | Stiemert |
| 4,145,063 | A | | 3/1979 | Knapp et al. |
| 4,160,301 | A | | 7/1979 | Woolley |
| 4,173,811 | A | | 11/1979 | Kokeisl |
| 4,221,024 | A | | 9/1980 | Becker |
| 4,222,490 | A | | 9/1980 | Wood, Jr. |
| D257,523 | S | | 11/1980 | Allsop |
| 4,244,498 | A | | 1/1981 | Copp |
| 4,248,365 | A | | 2/1981 | Jacobs |
| 4,268,050 | A | | 5/1981 | Kennedy, Sr. |
| 4,326,746 | A | * | 4/1982 | Grihalva ..... 294/146 |
| 4,333,677 | A | * | 6/1982 | Crump ..... 294/147 |
| 4,508,229 | A | | 4/1985 | Yost, Jr. |
| 4,530,168 | A | | 7/1985 | Petre |
| 4,531,644 | A | | 7/1985 | Margulies |
| 4,537,436 | A | | 8/1985 | Pfortmiller |
| 4,624,496 | A | | 11/1986 | Bengtson |
| 4,629,103 | A | | 12/1986 | Miller |
| 4,635,800 | A | | 1/1987 | Stempin |
| 4,678,087 | A | | 7/1987 | York |
| 4,696,504 | A | | 9/1987 | Roberts, Jr. |
| 4,718,138 | A | | 1/1988 | Brown et al. |
| 4,720,932 | A | | 1/1988 | Bovino |
| 4,733,897 | A | | 3/1988 | Schuetzeberg |
| 4,761,029 | A | | 8/1988 | Woodcock |
| 4,779,362 | A | | 10/1988 | Citrowske |
| D299,100 | S | | 12/1988 | Martinell et al. |
| 4,790,462 | A | | 12/1988 | Kawaguchi |
| 4,793,496 | A | | 12/1988 | Wait |
| 4,815,642 | A | | 3/1989 | Ray |
| 4,867,359 | A | | 9/1989 | Donovan |
| 4,900,061 | A | | 2/1990 | Kozma, Jr. |
| 4,927,176 | A | | 5/1990 | King et al. |
| 4,942,994 | A | | 7/1990 | Sterenberg |
| D316,620 | S | | 4/1991 | Magor |
| 5,007,185 | A | | 4/1991 | Lazarski |
| 5,042,839 | A | | 8/1991 | Ciari |
| 5,056,820 | A | | 10/1991 | Des Prez |
| 5,147,098 | A | | 9/1992 | McCrink |
| 5,156,418 | A | | 10/1992 | Kelly |
| 5,171,052 | A | | 12/1992 | Cunningham |
| 5,193,694 | A | | 3/1993 | Wave |
| 5,197,760 | A | | 3/1993 | Schollenberger |
| 5,285,939 | A | | 2/1994 | Hogan |
| 5,307,944 | A | | 5/1994 | Reedy |
| 5,358,277 | A | | 10/1994 | Klement, Jr. |
| 5,398,984 | A | | 3/1995 | Elder |
| 5,449,230 | A | | 9/1995 | Murray |
| 5,487,581 | A | | 1/1996 | Carmo et al. |
| 5,524,912 | A | | 6/1996 | Laub et al. |
| 5,599,052 | A | | 2/1997 | Van Davelaar |
| D378,245 | S | | 3/1997 | DeMier |
| 5,697,660 | A | | 12/1997 | Smetz |
| 5,713,097 | A | | 2/1998 | Brown |
| 5,806,691 | A | | 9/1998 | Nelson |
| 5,884,781 | A | | 3/1999 | Ehrhart |
| 5,960,558 | A | | 10/1999 | Bourgault |
| 6,050,873 | A | | 4/2000 | Reisman |
| 6,247,739 | B1 | | 6/2001 | Lyon |
| 6,273,272 | B1 | | 8/2001 | Hake |
| D453,667 | S | | 2/2002 | Wishnick |
| 6,454,335 | B1 | | 9/2002 | Wishnick |
| 6,827,226 | B2 | | 12/2004 | Coulson |
| 7,290,358 | B2 | | 11/2007 | Francis |
| 2004/0074113 | A1 | | 4/2004 | Kim et al. |
| 2004/0201236 | A1 | * | 10/2004 | Adelson ..... 294/159 |
| 2005/0067450 | A1 | | 3/2005 | Trejo et al. |
| 2005/0194803 | A1 | | 9/2005 | Perry |
| 2006/0273128 | A1 | | 12/2006 | Balakier |
| 2007/0051761 | A1 | | 3/2007 | McNeal |
| 2007/0204486 | A1 | | 9/2007 | Fenato |
| 2008/0011694 | A1 | | 1/2008 | Garceau |
| 2008/0079238 | A1 | | 4/2008 | Geisler et al. |
| 2008/0257925 | A1 | | 10/2008 | Brooks |
| 2011/0133503 | A1 | * | 6/2011 | Amato et al. ..... 294/158 |
| 2012/0011746 | A1 | | 1/2012 | Valaas |

OTHER PUBLICATIONS http://www.customskitools.com/custom-ski-accessories/custom-cross-country-ski-ties/, 2012.
http://www.rei.com, 2012.
http://www.skibones.com, 2012.
http://www.swixracing.us/nordic/products.cat.php?rid=4 2010-2011 Product Catalog, p. 63, 2012.
http://wvvw.toko.ch/en/apps/prodnctDetail.html, ToKo accessories—Ski Tie Nordic (24 pcs.), 2012.
http://www.toko.ch/en/apps/productDetail.html ToKo accessories—Ski Clip Nordic (60 pcs.), 2012.
International Search Report and Written Opinion of International Search Authority, PCT/US2011/00176, filed Jan. 31, 2011.
http://www.toko.ch/en/products/tools/accessories/skiholder-belt, 2012.
http://www.cozywinters.com/storage, 2012.
http://amazon.com/tndoorskistorage, 2012.
http://www.logfurnitureplace.com/product_info.php?, 2012.
http://skadinordic.com, 2012.
http://customskities.com, 2012.
http://skitie.com, 2012.
http://www.nordicskiersports.com/xc/swix-ski-straps-r0397.html, 2012.
http://www.alpinasports.com/index.php/nordic-race/category/boots, 2012.
http://www.rossignol.com/US/US/nordic-men-boots-skating.html, 2012.
http://www.madshus.com/boots, 2012.
http://www.fischersports.com/en/nordic/products/boots/race-classic, 2012.
http://www.salomon.com/us/#/nordic/boots, 2012.
http://www.skadinordic.com, 2012.

* cited by examiner

SKI BOOT CARRIER

BACKGROUND OF THE INVENTION

1. Technical Field

The present invention relates to a reusable, hand-held carrier for carrying and storing one or two ski boots having boot pins.

2. Background Information

Ski boots are carefully designed for particular types of skiing, such as cross-country skiing, and they can be quite expensive. Most skiers, especially competitive skiers, realize the importance of taking good care of their equipment, including their ski boots. Currently available ski boots include one or more boot pins on the sole of the boot for attaching the boot to ski bindings on a ski. Each boot pin is clasped by a corresponding part on the ski bindings just prior to use. It is important for safety as well as competitive reasons for ski boots to remain carefully attached to the skis while the skis are in use. Each boot pin extends laterally across the boot sole between boot treads. Ski boots are manufactured with the boot pins in place. Even if a boot includes only one boot pin, the pin normally extends across the small gap between boot treads at the front of the boot, close to the tip of the boot. The opposite ends of the boot pin are attached to the two boot treads, which are opposite and substantially parallel to one another at the front of the boot. A boot pin extends generally parallel to, and close to, the boot sole.

The present invention is a carrier for carrying ski boots when they are not being worn. The present boot carrier includes at least one hook element capable of clasping the forward boot pin and supporting the weight of the ski boot. One or two ski boots can be removably attached to the boot carrier of the present invention. The two ski boots hang on the present boot carrier until they are removed. Repeated attachment to the boot carrier does not damage the ski boots or the boot carrier. The boot carrier of the present invention can be used to carry a pair of ski boots from place to place, or the boot carrier can be hung up for transport or storage with the ski boots hanging from it. With the present carrier, the ski boots hang toe to toe and sole to sole, so the pair of boots forms a compact unit that is easier to carry. With this sole to sole hanging conformation, the soles with their boot pins and boot treads are adjacent and therefore more protected. This sole to sole conformation also helps prevent the wet, icy boot soles from contacting the skier and his/her dry clothes after skiing.

Once the user removes the ski boots from the boot carrier to put them on, the boot carrier can alternatively be used for supporting the skier's street boots or shoes, preferably by hanging each one by a loop extending from the upper part of the street shoe, usually at the ankle grazing part of the shoe upper. The present boot carrier can then be hung up with the street shoes attached until the skier returns from skiing and removes and changes back into the street shoes, hanging the wet ski boots back on the boot carrier.

BRIEF SUMMARY OF THE INVENTION

The present invention is a hand-held, reusable boot carrier for carrying one or two ski boots having boot pins prior to or after skiing, and for storing the ski boots. The present ski boot carrier includes: (a) a handle portion; (b) a shank including two opposite longitudinal first sides, an upper shank end of the shank being attached to a base handle section of the handle portion; (c) a hanger portion extending from a lower shank end that is opposite the upper shank end, the hanger portion including at least two elongate hook elements, each of the hook elements including an open topped channel and at least one shoulder portion, and preferably two, on an upper part of the wall of the channel within the hook element.

The carrier shank preferably further includes at least one shank recess between the opposite longitudinal first sides of the shank, and at least one carrier pin for supporting a sole guard ski boot accessory in the shank recess, the carrier pin extending into the shank recess from a floor at a bottom of the shank recess. The invention also contemplates a carrier wall mount and boot carrier set.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
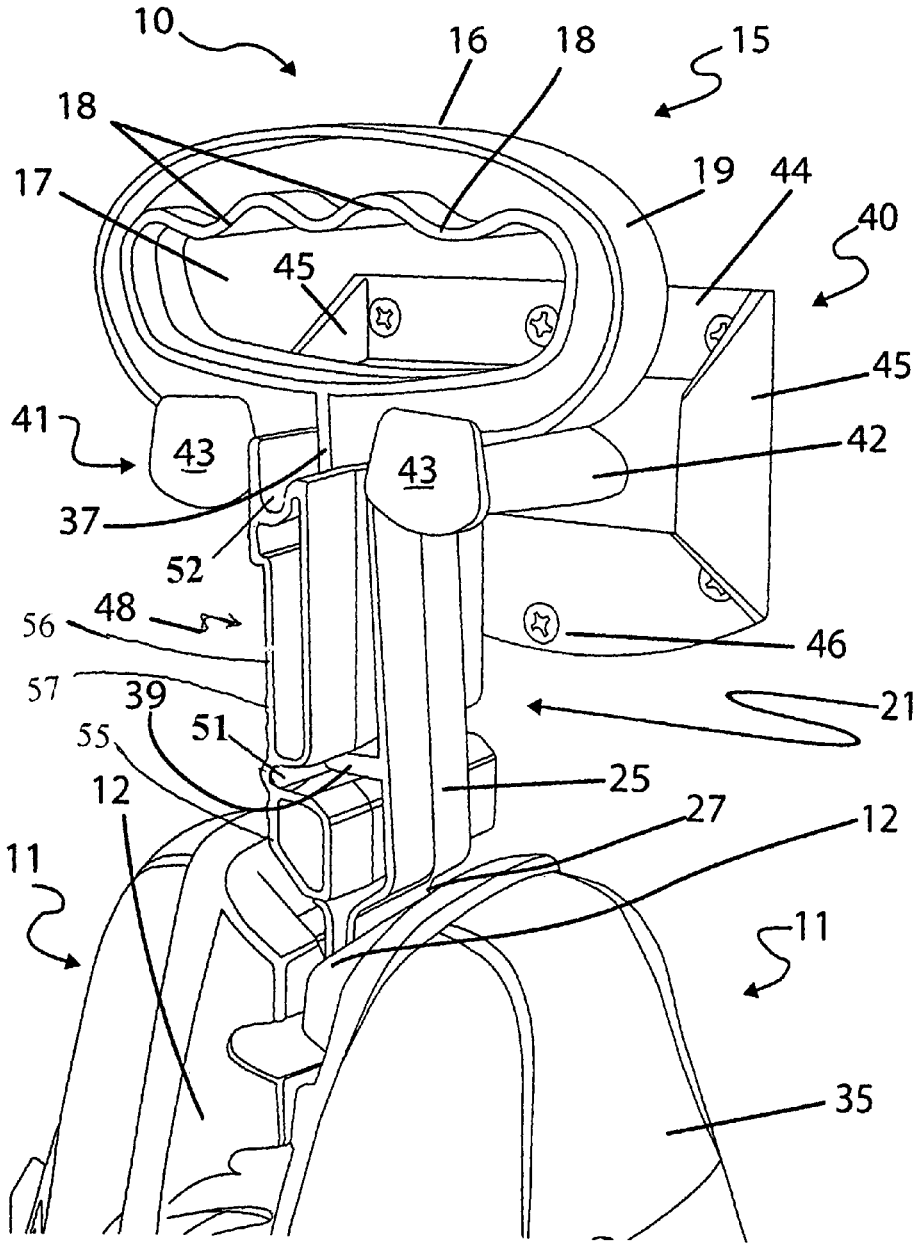
FIG. 1 is a perspective view of a boot carrier according to the present invention, shown hanging on a carrier wall mount and supporting a pair of ski boots.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, a device embodying the principles and concepts of the present invention and generally designated by the reference numeral 10 will now be described.

As seen in the figures, the reusable, hand-held carrier 10 for transporting or storing one or two ski boots 11 includes: (a) a handle portion 15; (b) a shank 21 with two opposite longitudinal first sides, an upper shank end 22 of the shank being attached to a base handle section 20 of the handle portion 15; (c) a hanger portion 26 extending from a lower shank end 23 that is opposite the upper shank end 22, the hanger portion 26 including at least two elongate hook elements 28, each of the at least two hook elements 28 including an open topped channel and at least one shoulder portion 30, 31 on an upper part of the wall of the channel within the hook element 28. A boot carrier 10 preferably has two of the hook elements 28, each having two shoulder portions, with one shoulder portion 30, 31 on each opposite inside wall of the hook element.

When the ski boot carrier 10 is in use, its handle portion 15 is preferably held in the skier's hand, with the pair of pin ski boots 11 extending below the boot carrier 10. By "hand-held"

is meant that the boot carrier 10 can be held and carried in one hand, although the boot carrier can alternatively be hung for transport and storage. By "pin ski boot" is meant a conventional ski boot with at least one boot pin 14 in the front of the sole of the boot. The shank 21 and hanger portion 26 of the boot carrier 10 extend below the handle portion 15. The handle portion 15 can alternatively be hung, for example, on a wall mount (see FIG. 1) or a hook or peg, a hang strap in a car, a hanger on a snowmobile, a loop on a knapsack, a belt loop, etc., as desired. The ski boot carrier 10 optionally comes in a set with a corresponding wall mount 40 for storage, as seen in FIG. 1.

The handle portion 15 includes an upper handle section 16, which curves into mirror image handle ends 19 at each end of the upper handle section 16. Each smooth handle end 19 curves down into an end of a base handle section 20. The upper handle section 16 is preferably substantially parallel to the generally horizontal base handle section 20. The handle portion 15 also includes a central hollow interior space 17 between the upper and base handle sections 16, 20.

The upper handle section 34 includes at least two finger indentations 18 on the bottom of the upper handle section 16 adjacent the interior space 17. The ripples are preferably wide enough to accommodate the skier's fingers, with or without thick ski gloves. The finger indentations 18 of the upper handle section 16 makes it easier to grip. Each of the four fingers of the carrying hand fit into one of the preferred four finger indentations 18. To carry the loaded boot carrier 10, the user extends four fingers of one hand through the handle interior space 17 and curls the four fingers around the upper handle section 16 so that the upper section 16 is clenched in the palm of the hand. The thumb of the carrying hand ideally rests on the smooth top surface of the upper handle section 16, or extends down, making a fist.

The ski boot carrier 10 is preferably one-piece, with a shank 21 that is continuous with the handle portion 15 above it and the hanger portion 26 below it. The upper end 22 of the shank 21 extends into the middle of the base handle section 20. The opposite, lower end 23 of the shank 21 continues into the hanger portion 26. The shank 21 preferably appears generally H-shaped in transverse cross section, with the longitudinal first sides 25 of the shank 21 forming the sides of the "H" cross section and the floor 38 forming the cross bar of the "H" on the second sides of the shank. Each side (longitudinal first side 25) of the "H" shape is longer than the cross bar (floor 38) of the "H". The carrier handle portion 15 is preferably wider from handle end 19 to opposite handle end 19 (horizontal) than the shank 21 is long (vertical) from upper end 22 to lower end 23.

When the boot carrier 10 is in use, the ski boots 11 hang from the lowest portion of the boot carrier 10, which is the hanger portion 26. The hanger portion 26 includes: a) a narrow central neck 27 extending down from the lower shank end 23; b) at least two elongate hook elements 28, each of which forms a hook shape with the hanger neck 27; c) an open topped channel 34 defined by each hook element 28 between the hook element 28 and the hanger neck 27; the hanger neck 27 terminating in d) a lower, generally planar tip end 33 of the hangar portion 26. The hook elements 28 and the lower tip end 33 give the hanger portion 26 an arrowhead shape. The boot carrier 10 is generally key-shaped. The lower tip end 33 of the hanger portion 26 is preferably generally planar for safety reasons. As shown in the figures, the boot carrier 10 includes two mirror image hook elements 28, each on an opposite side of the hanger neck 27, and two hook channels 34.

In regard to ski boots 11, different brands tend to differ somewhat in sole conformation, number of boot pins, and boot sole tread patterns, even though the various ski boot manufacturing companies manufacture ski boots to comply with the pertinent regulations. The boot carrier 10 accommodates different types of ski boots 11 with boot pins 14. The pin ski boot 11 need not be specially made to fit the boot carrier 10.

Some ski boots 11 have one pin, some two pins, and some three pins on the sole. Boot pins 14 on a ski boot 11 are preferably about the same dimension as one another. The boot sole pins 14 normally extend transversely across a front sole portion of the boot sole 12 substantially parallel to and spaced part from one another. The pins 14 are also normally substantially parallel to the boot sole 12. One common type of ski boot 11 includes two short boot pins 14, each of which extends between two corresponding treads 13 over a longitudinal midline channel in the boot sole 12. For skiing, the boot pin or pins 14 are clasped by ski bindings on a ski. Just as ski boots vary, different types of ski bindings differ from one another. A good fit is vital for holding the ski boots 11 in ski bindings. Ski bindings prevent skis from popping off ski boots during the often demanding twists and turns of cross-country, backcountry touring, or other types of skiing.

Continuing with the carrier hanger portion 26, each hook element 28 preferably extends up below one end 19 of the handle portion 15. The handle portion 15 and the hanger portion 26 lie in the same plane. This is advantageous in that the boot uppers 35 do not hit the skier in the leg as the skier carries the boot carrier 10 in one hand during down time. This benefit is particularly significant when the ski boots perched on the carrier are a large size (e.g., size ten and up). Instead, the top/upper 35 of one ski boot extends forward (out to the front of the skier) and the top/upper of its mate extends backward, away from the skier's leg when the carrier is in use. The boot soles 12 preferably contact one another as seen in FIG. 1 as they hang from the boot carrier 10. This is also a benefit in that it keeps snow and ice, which commonly accumulate on ski boot soles during use, away from the skier's clothes while the boots are being carried. Instead, the icy boot soles are in contact with one another.

When a pair of ski boots 11 is hung on the boot carrier 10 by the boot pins 14, the ski boots 11 hang sole to sole, as seen in FIG. 1. When the ski boots 11 are in use, the soles 12 of the boots are generally horizontal. When they are hung on the boot carrier 10, the ski boots 11 hang generally vertically, which permits snow/ice melt to drip down from the backs of the boots onto the ground. With the boot soles 12 contacting one another as the pair of boots hangs generally vertically from the boot carrier 10, the boots are less likely to bang against one another or against the user's leg, even when the boot carrier is jostled as the user walks over rough terrain.

Figure 2:
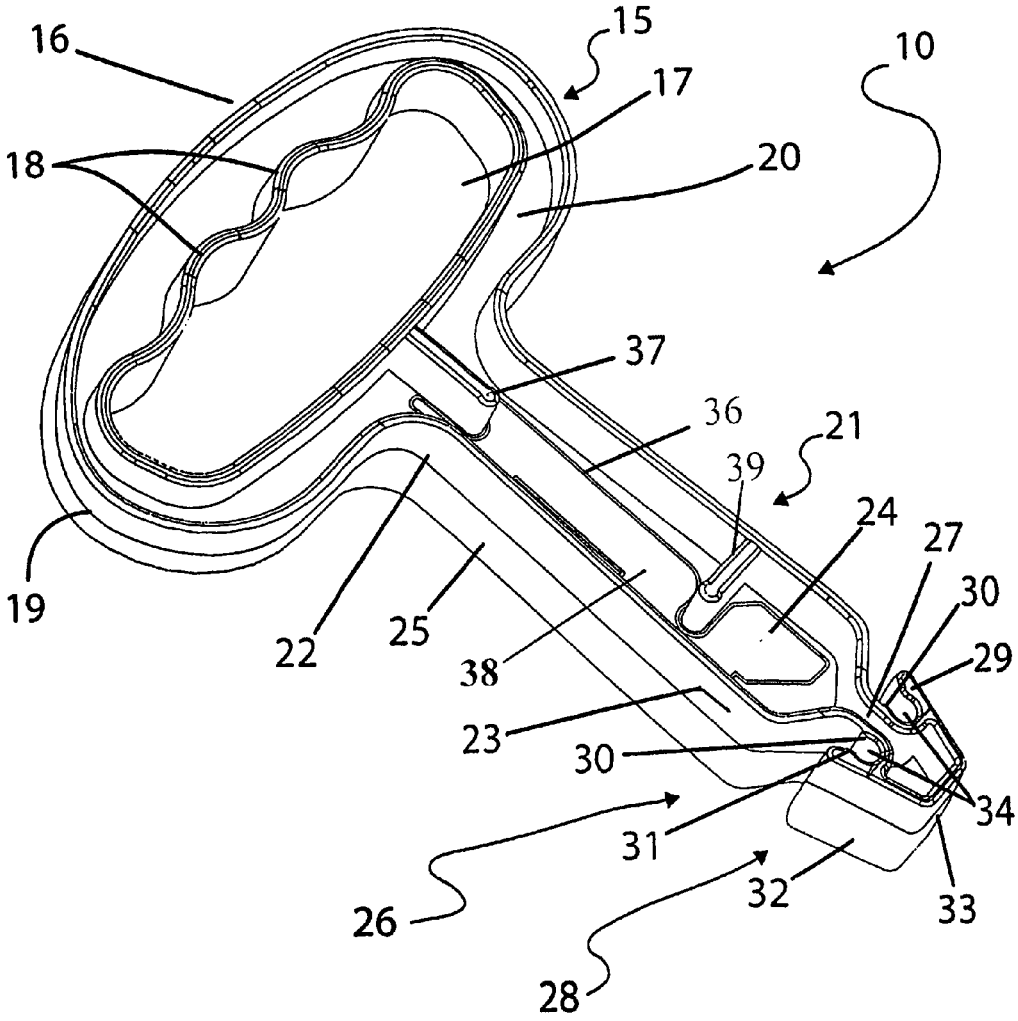
FIG. 2 is a perspective view of a boot carrier according to the present invention.
Figure 4:
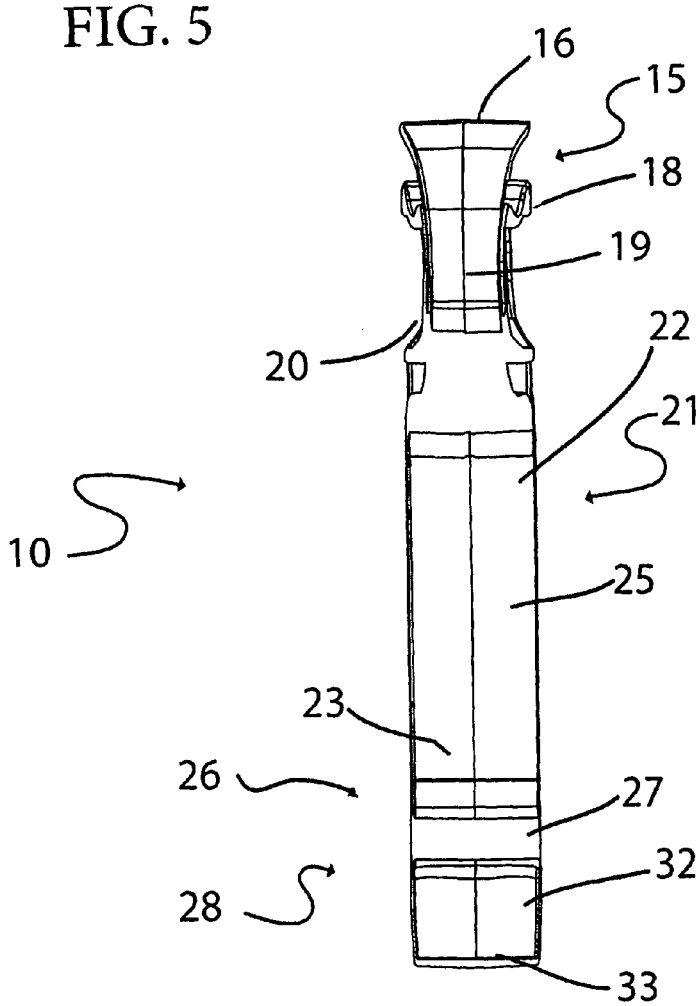
FIG. 4 is a side elevational view of a boot carrier according to the present invention.
Figure 6:
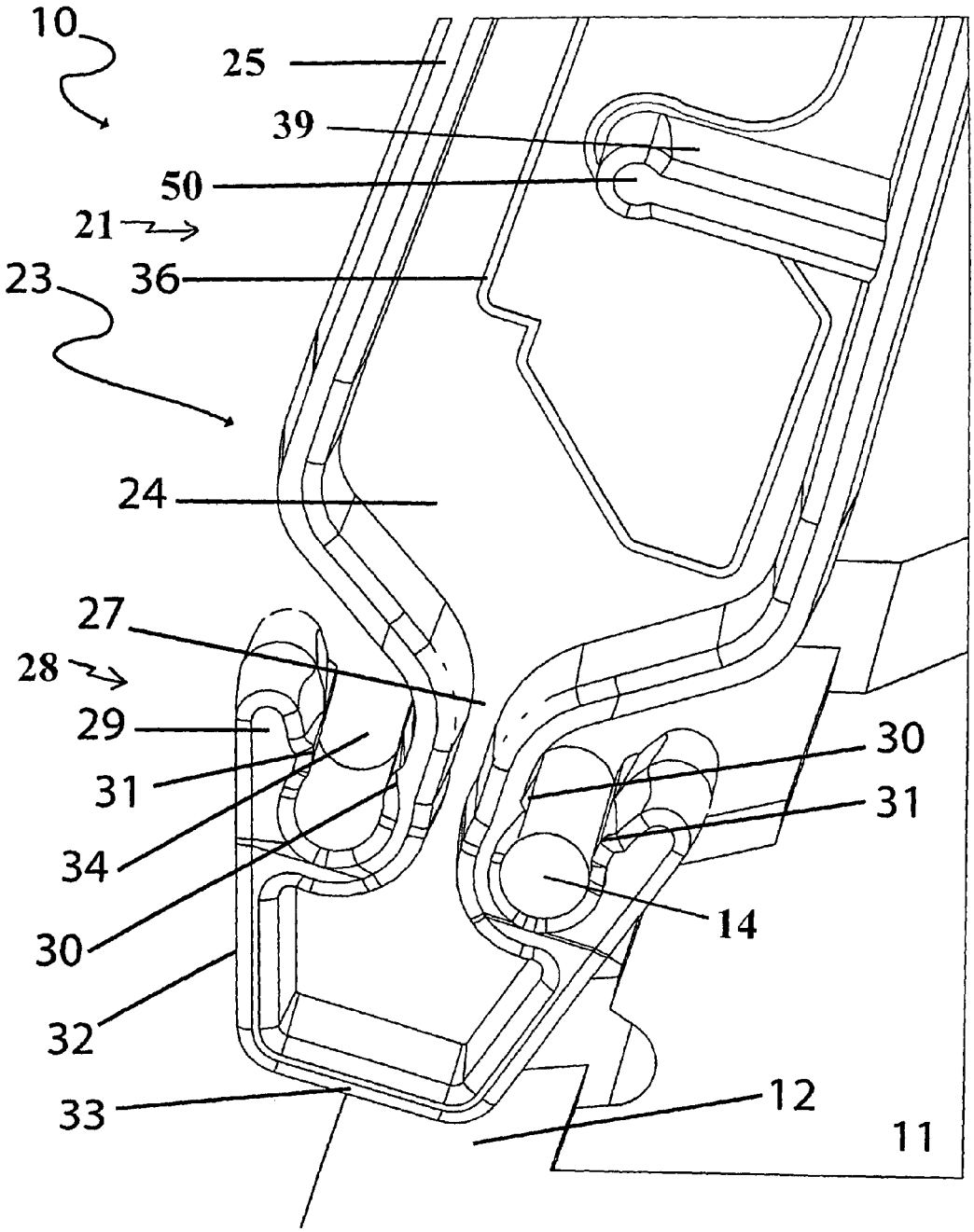
FIG. 6 is a perspective view of a lower portion of the boot carrier of FIG. 2, shown with a section of a boot pin in one channel and with a cross-sectioned ski boot in the background for purposes of illustration.
Figure 7:
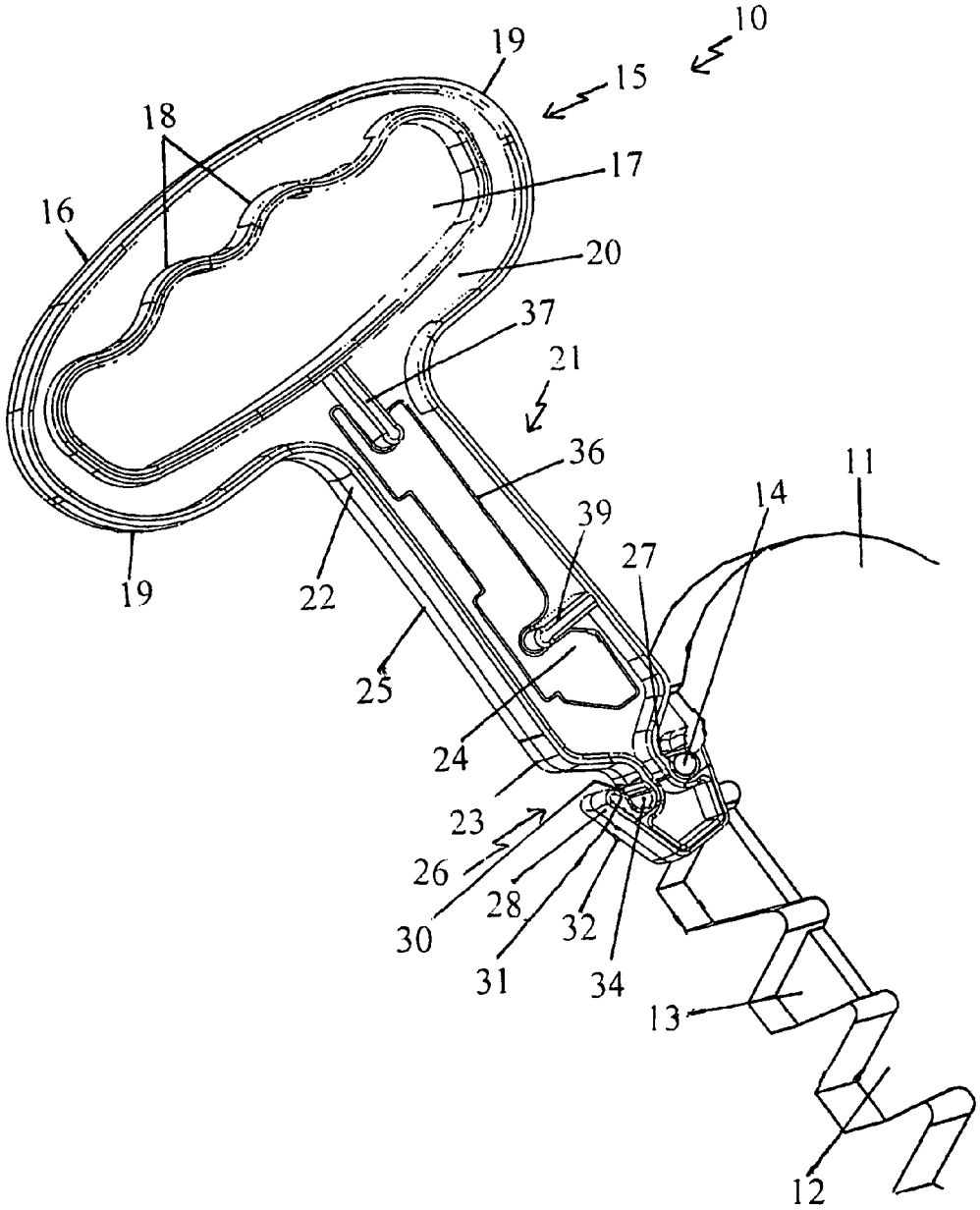
FIG. 7 is a perspective view of the boot carrier according to the present invention, shown in use with a cross-section of a ski boot.

The hook elements 28 of the hanger portion 26 are elongated (wider than they are long), so they are not the same as a conventional wall hook. Each hook element 28 has the approximate length of a ski boot pin 14, and the ski boot pin 14 fits closely in the hook channel 34 as seen in FIGS. 6 and 7. The thickness of the carrier shank 21 and hanger portion 26 then, substantially corresponds to the width of a boot pin 14. The smooth sides 32 of the elongate hook elements 28 preferably have about the same width as the smooth, longitudinal sides 25 of the shank 21, as seen in FIGS. 2 and 4. The hook elements 28 fit closely to the carrier body, which minimizes the likelihood that they will break off when subjected to repeated use. The hangar portion neck 27 extends between the two hook elements 28. The back of the hook element 28 is formed by the surface of the neck 27. A free hook section 29 of the hook element 28 angles up from the back, forming a hook channel 34 that is open at the top.

Figure 3:
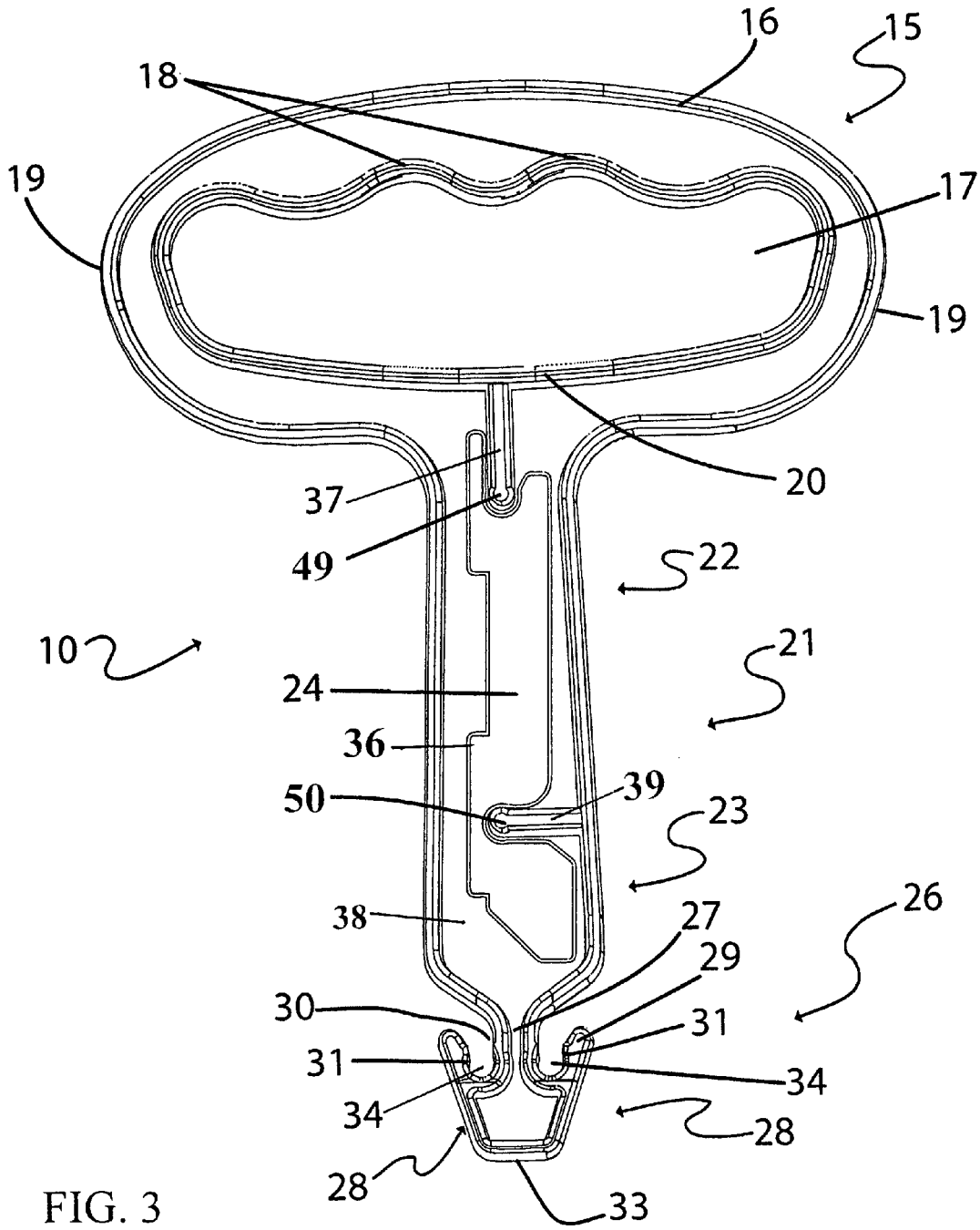
FIG. 3 is a front elevational view of the boot carrier according to FIG. 2.
Figure 5:
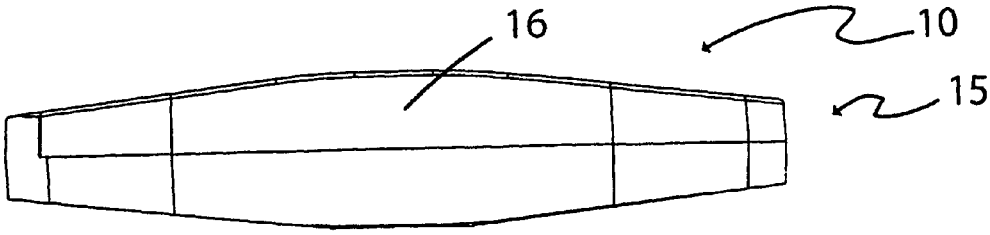
FIG. 5 is a top plan view of the boot carrier of FIG. 2.

Each of the hook elements 28 preferably includes at least one shoulder portion 30, 31 in the interior of each hook element 28, as seen in FIGS. 3 and 6. The boot carrier mold preferably includes shoulder portions 30, 31 molded into the boot carrier. A boot carrier 10 preferably includes two mirror image shoulder portions 30, 31 that face one another in the interior curve of each hook element 28. Each shoulder portion 30, 31 extends generally horizontally along the generally horizontal channel 34, as seen in FIG. 6. Preferably, the boot carrier 10 includes a free hook shoulder portion 31 on the interior surface of the free hook section 29 of each hook element 28. The neck shoulder portions 30 are on the outside surfaces of the neck 27. The neck shoulder portions 30 are opposite one another, each one facing out toward the corresponding free hook shoulder portion 31. The shoulder portions 30, 31 are significant in that the boot pin 14 of the ski boot 11 fits closely into the hook element 28, squeezing through the gap between the shoulder portions 30, 31 into the channel 34. The shoulder portions 30, 31 prevent the boot pin 14, and therefore the ski boot 11, from easily pulling out of the hook element 28.

The shoulder portions 30, 31 are preferably constructed so that the boot pin 14 snaps, or pops, into the channels 34 of the hook elements 28. The snap fit, along with gravity, help ensure that the ski boots 11 will remain in place until they are removed. The snap also functions as an audible/sensory signal to the skier that the ski boot is "locked" in place on the boot carrier 10.

On each side of the carrier, there is one shoulder portion 30 on the outside surface of the neck 27 of the hanger portion 26, and a second shoulder portion 31 on the inside surface of the free hook section 29 of the hook element 28. The shoulder portions 30, 31 extend parallel to one another along the opposite walls (neck and free hook section) of the channel 34. Each set of shoulder portions, which is preferably molded into opposite walls of the channel 34, forms a pinched zone in the channel 34 that is slightly narrower than the rest of the channel 34, so that it takes a certain amount of pressure to pop the boot pin 14 into or out of the channel 34. The boot 11, then, will not come off the boot carrier 10 until the skier removes it.

Use of the shoulders 30, 31 allows the boot pins 14 to sit in the channel 34 below the shoulders that is spacious enough to let the boot pins 14, and hence the ski boots 11, rotate. This creates a hinge point on the device so that the user may swing his or her arm naturally while carrying boots on the boot carrier 10 without exerting undue torque on the hand or wrist. When the user swings his or her arm forward, gravity rotates the boots 11 to remain aligned more or less vertically, thus keeping the weight of the boots more or less directly beneath the user's hand.

The carrier material is sufficiently rigid that it does not bend or break under the weight of the relatively heavy ski boots, nor do the hook elements 28 break off. Boot carriers 10 are preferably made of an inexpensive but durable plastic material, such as polyethylene, polystyrene, or ABS (a copolymer of acrylonitrile, butadiene, and styrene), although any suitable material may be employed. The boot carrier material withstands freezing conditions and exposure to melt water, as well as the rapid temperature changes experienced when the skier moves between inside and outside.

The boot carrier 10 is small, and lightweight. The boot carrier 10 is preferably neon colored or otherwise brightly colored so that it is easy to locate, especially in the snow or on the ground. The skier can easily carry an unused boot carrier 10 in one hand, a pocket, or a pouch or water bottle holder pack. The boot carrier 10, with or without ski boots, can be hung from a loop, strap, hook, etc. on a ski, purse, or backpack, inside a vehicle, etc., as desired.

If desired, letters or graphics, like logos or words, may be imprinted on or molded into the smooth sides 25 of the boot carrier 10. The front and rear interior of the boot carrier 10 is preferably recessed, or shelled out, to reduce the amount of material used and therefore manufacturing costs, as well as meet manufacturing requirements. The recessed interior 24 of the shank 21 is seen in FIGS. 1-3.

Since one pair of boots might be better suited to the weather and course terrain on a particular day, or just to have a back-up pair of dry boots in case one malfunctions or is excessively wet, a cross country skier or other competitor might wish to carry two pairs of ski boots, with one boot carrier 10 in each hand.

When the boot carrier 10 is not being carried, it can be hung on a hook or strap, such as a backpack strap or a clothes hook in a car, or a support such as the carrier wall mount 40 shown in FIG. 1. The carrier wall mount 40 includes a mounting bracket 44, preferably one with a bracket side 45 extending substantially perpendicularly out from each opposite, vertical edge, and two carrier support pegs 41 extending out from the bracket. The support pegs 41 are spaced a sufficient distance apart for the carrier shank 21 to fit between them. The handle portion 15 of the boot carrier 10 rests on top of the support pegs 41 when the boot carrier 10 is being stored on the wall mount 40, as seen in FIG. 1. Each support peg 41 has a peg base 42, which is attached at one end to the mounting bracket 44. A substantially planar peg stop 43 is attached to the other end of each peg base 42. The peg stops 43 prevent the boot carrier 10, and any ski boots 11 hanging from it, from slipping off in the event a breeze, family pet, etc. brushes by it. The blunt (planar) peg stops 43 are also safer in the event a person or animal brushes by or bumps into the wall mount 40.

Continuing with FIG. 1, the mounting bracket 44 is screwed or otherwise attached to a wall or other suitable surface by screws 46 or other conventional means. As seen in FIG. 1, the support pegs 41 are long enough for a pair of ski boots 11 to hang freely below the boot carrier 10 without banging on the wall. The boot carrier 10 can easily be placed on the wall mount 40 and removed from the wall mount 40. Attachment of the boot carrier 10 to the wall mount 40 is not required. Other suitable means of supporting the boot carrier 10 may be alternatively employed. The support pegs 41 are alternatively long enough to extend through the handle interior space 17 to support the weight of the boot carrier, as well as any ski boots 11 on the boot carrier 10.

Thus, the combination boot carrier 10 and wall mount 40 includes:

(a) a boot carrier 10 including a handle portion 15, a shank 21, and a hanger portion 26, the carrier handle portion 15 including an upper handle section 16, a base handle section 20, two mirror image handle ends 19, and a central interior space 17 between the upper handle section 16 and the base handle section 20, each of the two mirror image handle ends 19 extending between an opposite end of the upper handle section and an opposite end of the base handle section 20, the upper handle section 16 being substantially parallel to the generally horizontal base handle section 20; the carrier shank 21 including two opposite first sides 25, and an upper shank end 22 attached to the base handle section 20; and the carrier hanger portion 26 being attached to a lower, opposite end 23 of the shank 21, the hanger portion 26 including at least two elongate hook elements 28, each of the at least two hook elements 28 including an open topped channel 34 and at least one shoulder portion 30, 31 along at least one wall of the channel 34 within the hook element 28; and (b) a carrier wall mount 40 including: at least one support peg 41, the support peg 41 including a peg base 42 with a peg stop 43 at one end of the peg base 42, an opposite end of the peg base 42 being attached to the mounting bracket 44. The handle portion of the boot carrier is removably hangable on the reusable carrier wall mount 40. The boot carrier 10 can alternatively be carried in a hand, or hung on a wall hook, strap, or any other suitable location. There are preferably two support pegs 41, which are extendible under the base handle section 20 or through the carrier handle space 17.

A specialized wall mount 40 for mounting on a slatted wall includes top and bottom mount slat inserts at the top and bottom edges, respectively, of the slat wall mount 40 for insertion between two sets of slats on a slatted wall. The mount slat inserts support the wall mount 40 on the slatted wall, with or without a boot carrier 10 on the wall mount 40, and with or without ski boots 11 on the boot carrier 10, until the wall mount 40 is removed from the slatted wall.

The boot carrier 10 is intended for carrying ski boots 11 with boot pins 14, or alternatively ski boots or walking boots or shoes with loops 38 on the rear. The walking boots are hung on the carrier hook elements 28 by the loops 38 on the rear end of each of the boots, if preferred. Thus, once the user removes the ski boots 11 from the boot carrier 10 to put them on, the boot carrier 10 can be used for supporting the skier's street boots or shoes. The street boots or shoes are each hung by a loop 38 extending from the shoe upper 34, usually at the rear, ankle-grazing part of the shoe upper. The boot carrier 10 can then be hung up with the street shoes or boots attached until the skier returns from skiing and removes and changes back into the street shoes or boots, hanging the wet ski boots 11 back on the boot carrier 10. Boots or shoes can alternatively be hung from the hook elements 28 by the tied together shoelaces of each boot.

Although carrier size can certainly vary, a set of preferred measurements for a boot carrier 10 is as follows:

a) handle portion 15: from about 10 to about 14 centimeters in width (from the outside of one handle end 19 to the outside of the other handle end), from about 4 to about 7 centimeters in height (from the top of the upper handle section 16 to the bottom of the base handle section 20), and from about 1 to about 4 centimeters in thickness (from an outside surface of one handle end 19 to the inside surface of the same handle end);

b) shank 21: from about 6 to about 10 centimeters in height (from the upper shank end 22 to the lower shank end 23), from about 1 to about 4 centimeters in width (from the outside of one shank side 25 to the outside of the opposite shank side), and from about 1 to about 4 centimeters in thickness (from the front to the back of the shank 21); and c) hanger portion 26: from about 1 to about 4 centimeters each in height, width and thickness.

Measurements for a most preferred embodiment of the boot carrier 10 are as follows: a) handle portion 15: about 12 centimeters in width, about 5-6 centimeters in height, and about 1-2 centimeters in thickness; b) shank 21: about 8-9 centimeters in height, about 2-3 centimeters in width, and about 2-3 centimeters in thickness; c) hanger portion 26: about 1-2 centimeters each in height, width and thickness. However, any other suitable boot carrier measurements are also contemplated herein.

As seen in FIG. 1, the boot carrier 10 preferably also supports a boot sole guard ski accessory within the shank recess 24, preferably one sole guard 48 on each side of the shaft 21. The boot carrier 10 is used to store the sole guard 48, or pair of sole guards, when they are not in use covering the boot pins 14 of the ski boots 11. The boot carrier 10 is used for storing or transporting the sole guard ski accessories. The sole guard 48 fits over the boot pin 14 or pins on the ski boot during the time when the skier is wearing the ski boots 11. The sole guards 48 prevent ice, snow, and small debris from building up around the boot pins 14 as the skier walks around. The sole guards 48 are removed from the ski boots 11 just before the skier puts the ski boots in the ski bindings on a pair of skis. Instead of having to store the small sole guards 48 loose in the skier's pocket or another location where they might be misplaced, they can be stored on the boot carrier 10, with or without the ski boots on the carrier, with one sole guard 48 on each side of the boot carrier 10 as seen in FIG. 1. The sole guards 48 fit closely on the boot carrier 10 so they are not easily jarred loose. The sole guards 48 are partially protected by the side walls of the shank 21, which extend about halfway up the sole guard.

In the boot carrier 10, the sole guards 48 fit over two carrier pins 37, 39 that are preferably molded into the boot carrier 10. Each pin projects out into the shank recess 24. The bases of the carrier pins 37, 39 are attached to the floor 38. The carrier pins 37, 39 preferably extend generally perpendicular to each other, most preferably about 4-5 centimeters apart. The carrier handle pin 37 extends down from the base handle section 20, the end of the carrier handle pin 37 being attached to the base handle section 20. The carrier shank pin 39 extends into the shank recess 24 from one side 25 or the other of the shank 21. On the opposite side of the boot carrier 10, the carrier pins 37, 39 may be in the same pattern on that floor 38.

A sole guard outline 36 is provided in the floor 38 of the shank 21, as seen in FIGS. 2, 3 and 7. The slightly raised sole guard outline 36 is preferably molded into the floor 38. The sole guard outline 36 depicts how the sole guard 47, 48 fits in the carrier shank 21, reminding the skier where the sole guard 48 is placed in the shank recess 24, and how it is positioned. The sole guard outline 36 saves the skier a few seconds trying to figure out how to fit the puzzle piece-like sole guard 47, 48 into the shank recesses 24 on either side of the boot carrier 10. The carrier pins 37, 39, which are extruded from the shank 21, project into two pin grooves 51, 52, respectively, of the sole guard 48, where boot pins 14 fit when the sole guard 48 is in use on the pin ski boot 11.

The shank pin 39 may alternatively extend out from the inner wall of the opposite side 25 of the shank 21 rather than the side shown in FIGS. 2 and 3. When the shank pin 39 extends out from the inner wall of the opposite side of the shank 21, the sole guard outline 36 is flipped (reversed) from the guard outline shown. In that case, the opposite side of the sole guard 48 is placed against the floor 38 of the shank 21 when the sole guard 48 is being stored in the boot carrier 10.

The sole guard 47, 48 fits closely within the shank recess 24, so it is unlikely to fall out (see FIG. 1). The pin grooves 51, 52 of the two-pin sole guard 48 fit over rounded, or enlarged, pin heads 49, 50 on the ends of the carrier pins 37, 39, respectively. The rounded pin heads 49, 50 have substantially the same diameter as the fairly standard boot pins 14. Just as the sole guards 47, 48 snap into place over the boot pins 14, they snap, or pop, into place over the carrier pins 37, 39. The snap fit, along with gravity, help ensure that the ski boots 11 will remain in place until they are removed. The snap also functions as an audible/sensory signal to the skier that the sole guard 47, 48 is "locked" in place on the boot carrier. A similar sound effect occurs when the front boot pin 14 of the ski boot 11 snaps into the hook channel 34.

A set of two-pin sole guards 48 is shown stored on the boot carrier 10 in FIG. 1. The boot carrier 10 can alternatively be used to store a set of one-pin boot guards 47, with one sole guard 47 on each opposite side of the shank 21. A one-pin sole guard 47 is shown clasped over the shank pin 39 in FIG. 8. The single pin groove 51 of the one-pin sole guard 47 slides down over the shank pin 39, with the rounded head 50 of the shank pin 39 fitting closely into the rounded end of the guard pin groove 51. The one-pin, one groove sole guard 47 is shorter than the two-pin, two groove sole guard 48, so the one-pin sole guard 47 does not contact the handle pin 37 when it is in the boot carrier. It is not necessary for the sole guards 47, 48 to fit all the way down into the shank recess 24, since they are held tightly enough in the boot-sole guard carrier 10. The top and bottom of the sole guards 47, 48 contact the inside shank sides 25. The shank sides 25 only extend partway up the sides of the sole guard 47, 48.

The one-piece, reusable two-pin ski boot sole guard 48 seen in FIG. 1 includes: (a) a head portion 55 comprising a substantially planar top head surface that is substantially parallel to an opposite, bottom surface of the sole guard; (b) a body portion 56 adjacent the head portion 55, the body portion 56 comprising a substantially planar top body surface that is substantially parallel to an opposite, bottom surface of the sole guard; (c) at least two pin grooves 51, 52; (d) two opposite guard sides; and (e) a number of projections, preferably toothed segments 57, extending in a downward direction from the guard bottom surface. Two two-pin guards 48 are preferably stored in the shank recesses 24 of the boot carrier 10.

Continuing with the two-pin sole guard 48 shown in FIG. 1, the sole guard sides are preferably mirror-images of, and substantially parallel to, one another. Each sole guard side is substantially perpendicular to the top body surface and the bottom surface of the sole guard 48. The top body surface of the guard body portion is preferably substantially smooth and rectangular in shape, as seen in FIG. 1. The head portion 55 includes a front end surface that is opposite the rear end surface of the sole guard. The front end surfaces are generally visible to an observer when the sole guards 48 are in place on a pair of ski boots 11.

As depicted in FIG. 1, the main pin groove 51 of the sole guard 48 extends down between the rear of the guard head portion 55 and the front of the body portion. The main pin groove 51 opens to the top of the sole guard 48. The second pin groove 52 extends in from the rear end surface of the sole guard, and it opens to the rear of the sole guard. In the two-pin sole guard 48, the second pin groove 52 extends substantially perpendicular to the main pin groove 51, which is toward the front of the sole guard 48. When the boot sole guard 48 is fitted on the ski boot 11, the second pin 14 of the ski boot 11 is pressed into the second pin groove 52, and the first pin 14 of the boot is then pressed into the main pin groove 51 of the sole guard 48. Each pin groove 51, 52 at its bottom, then, is only slightly wider than the diameter of the boot pin 14 to ensure a close fit. Boot pins 14 on a boot are preferably about the same dimension as one another. The guard pin grooves 51, 52 preferably also have about the same dimensions as each other.

Figure 8:
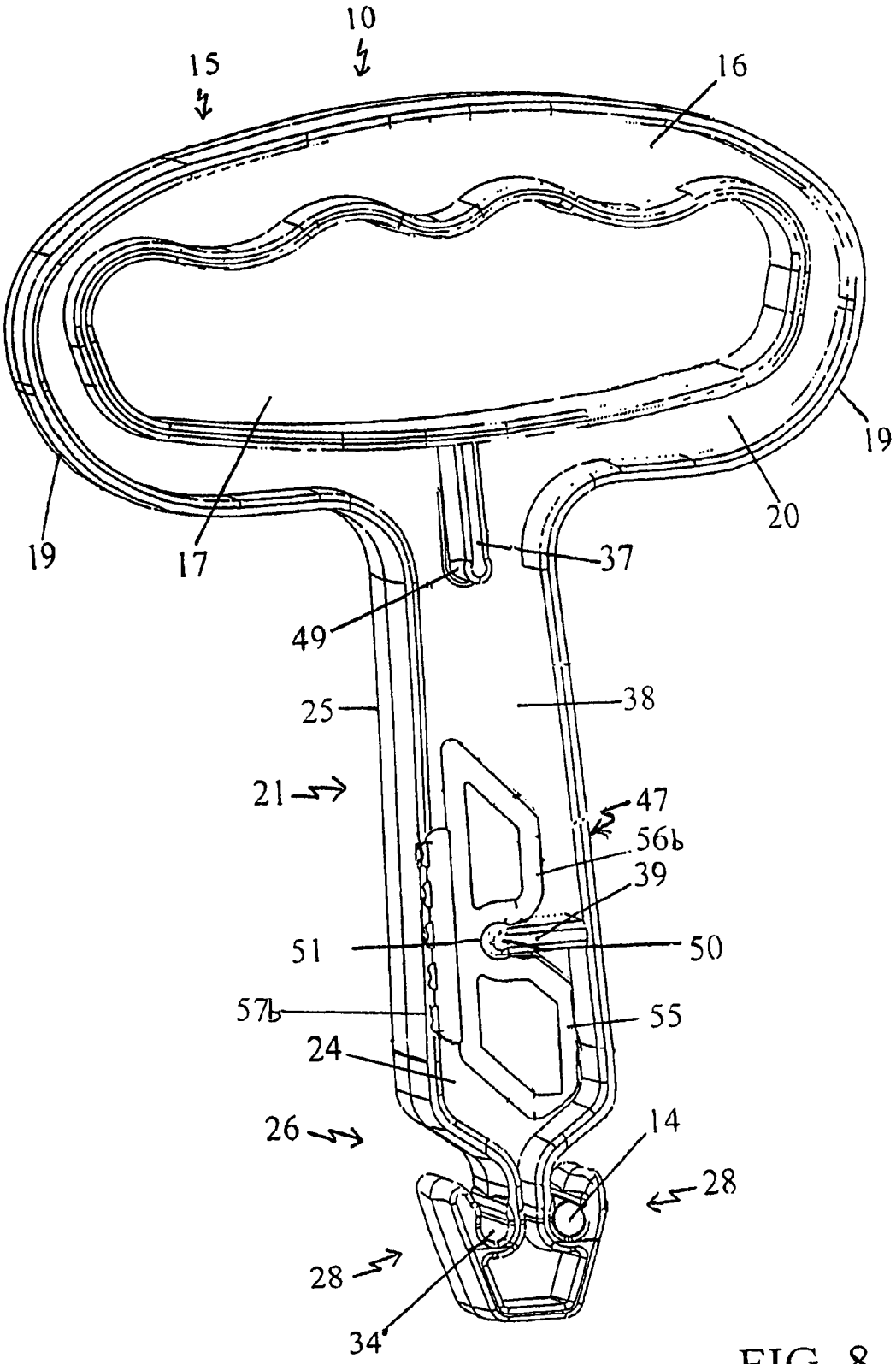
FIG. 8 is a front elevational view of a boot carrier according to the present invention, shown with a one-pin sole guard.

The boot carrier 10 alternatively holds one or two reusable, one-piece one-pin ski boot sole guards 47, as seen in FIG. 8. The one-pin guard 47 includes: (a) a head portion 55 comprising a substantially planar top head surface that is substantially parallel to an opposite, bottom surface of the boot sole guard 47; (b) a body portion **56*b* adjacent the head portion 55, the body portion 56*b* comprising a substantially planar top body surface that is substantially parallel to the opposite, guard bottom surface, and to the top head surface, the guard bottom surface extending along the bottom of both the head portion and the body portion; (c) a pin groove 51 between the head portion 13 and the body portion 56*b*; (d) two opposite guard sides; (e) a sloped rear surface connecting a posterior end of the top body surface and a posterior end of the bottom surface; and (f) a number of projections 57*b* extending in a downward direction from the guard bottom surface under the head portion 55 and the body portion 56*b*. Preferably but not necessarily, the head portion 55 includes at least one hollow, and the body portion 56*b* includes at least one hollow. The projections are preferably toothed segments 57*b* on a platform on the bottom surface of the one-pin guard 47. The platform preferably extends under the head portion 55, the pin groove 51, and the body portion 56*b***.

Continuing with the one-pin sole guard 47, the guard sides are preferably mirror-images of, and substantially parallel to, one another. Each sole guard side is substantially perpendicular to the top body surface and the bottom surface of the boot sole guard 47. The sole guard bottom surface is preferably substantially rectangular in shape.

As seen in the sole guard 47 of FIG. 8, the top head surface of the head portion 55 is preferably above the plane of the top body surface **56*b*, a front end surface of the head portion 55 being adjacent the lower, substantially planar, sloped front surface of the head portion 55. The head portion 55 of the one-pin sole guard 47 is taller than the body portion 56*b*, so that the front of the sole guard 47 juts forward from the boot toe in both the two-pin sole guard 48 of FIG. 1 and the one-pin sole guard 47 seen in FIG. 8. When it is on the boot, the front of the sole guard juts out so that the wearer can push down on the projecting front portion of the one-pin or two-pin sole guard 47, 48 with a ski pole, stick, hand, etc. when the wearer wishes to remove the sole guard from the ski boot 11. The top body surface is thus on a lower plane than the top head surface. The bottom surface of the sole guard 47, 48 is continuous/the same for both the head and body portions, so that a generally smooth walking surface is provided for the user. The head and body portions 55, 56*b* are of course connected below the main pin groove 51 in the one-pin and two-pin sole guards. The pin groove(s) adds flexibility to the sole guard 47, 48**.

As seen in FIG. 8, the head lower front surface extends between the lower end of the front end surface and the posterior end of the guard bottom surface. The head lower front surface is preferably substantially parallel to the guard sloped rear surface. The substantially planar, sloped front surface of the head portion 55 is angled in order to provide a smooth roll forward of the ski boot 11 while walking with the boot sole guard 47 in place. The guard rear surface of the one-pin sole guard 47 is angled, with the top body surface adjacent the boot sole 12 to prevent snow accumulation, and with an edge forming a blade.

The rear end surface of the one-pin boot sole guard 47 is slanted to correspond to the slanted front face of the boot tread 13 that is adjacent the sole guard 47 when the sole guard is on the boot 11. A close fit of the sole guard 47 in the boot sole recess is desirable in order to block snow and debris from entering the front boot sole recess that is occupied by the sole guard 47. Since the bottom of the ski pole contacts the flat top head surface of the head portion 55 of the sole guard when the user is removing the sole guard (whether one-pin or two-pin) and since an overly protruded front end could interfere with the user's walking motion, the lower front surface of the sole guard is angled in, as seen in FIGS. 1 and 8. The angle of the rear end surface of the one-pin sole guard 47 corresponds to the angle of the lower front surface.

The ski boot 11 pops into place on the boot carrier 10; no screws, snaps, hook and loop strips, friction strips, or other fasteners are required to hold the boot(s) in place on the boot carrier 10. The boots are not permanently mounted on the ski boot carrier 10. The elongated hook elements 28 of the boot carriers 10 are designed to carry ski boots 11 by their boot pins 14, or street boots or shoes by their rear loops or tied shoelaces, but are not meant to carry other objects, like plastic bags or purses. The ski boot 11 need not be specially made to accommodate the boot carrier 10.

From the foregoing it can be realized that the described device of the present invention may be easily and conveniently utilized as a ski boot carrier. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 ski boot carrier
11 ski boot
12 boot sole
13 boot tread
14 boot pins
15 handle portion
16 upper handle section
17 handle interior space
18 finger indentations
19 handle end
20 base handle section
21 shank
22 upper shank end
23 lower shank end
24 shank recess
25 longitudinal shank sides
26 hanger portion
27 hanger portion neck
28 hook element
29 free hook section
30 neck shoulder portion
31 free hook shoulder portion
32 side of hook element
33 hanger portion tip
34 hook channels
35 boot upper
36 sole guard outline
37 carrier handle pin
38 floor in shank
39 carrier shank pin
40 carrier wall mount
41 support pegs
42 peg base
43 peg stop
44 mounting bracket
45 bracket sides
46 bracket screws
47 sole guard, one pin
48 sole guard, two pin
49 rounded head of handle pin
50 rounded head of shank pin
51 main guard pin groove
52 second guard pin groove
55 guard head portion
56 guard body portion
57 guard toothed segments

What is claimed is:

1. A reusable boot carrier for carrying or storing at least one pin ski boot, the reusable boot carrier comprising: (a) a handle portion; (b) a shank comprising two opposite longitudinal first sides, an upper shank end of the shank being attached to a base handle section of the handle portion; (c) a hanger portion extending from a lower shank end that is opposite the upper shank end, the hanger portion comprising at least two elongate hook elements, each of the at least two hook elements comprising an open topped channel and a set of corresponding shoulder portions, each on an opposite wall of the channel, the set of shoulder portions forming a pinched zone at a top of the channel of the hook element; wherein a length of the shank plus a length of the hanger portion is about equal to a length of the handle portion.

2. The boot carrier according to claim 1, wherein the shank further comprises at least one shank recess on a second side of the shank, opposite longitudinal edges of the shank recess being bordered by the opposite longitudinal first sides of the shank, and at least one carrier pin extending into the shank recess from a floor of the shank recess.

3. The boot carrier according to claim 2, comprising two of the at least one shank recesses, with one of the two shank recesses on each opposite, second side of the boot carrier, and further comprising a sole guard outline on each opposite floor of the shank recesses, and two of the at least one carrier pins, each carrier pin being attached to an opposite one of the floors.

4. The boot carrier according to claim 2, wherein the handle portion comprises an upper handle section, the base handle section, two mirror image handle ends, and a central interior space between the upper handle section and the base handle section, each of the two mirror image handle ends extending between an opposite end of the upper handle section and an opposite end of the base handle section, the upper handle section being substantially parallel to the generally horizontal base handle section; a bottom surface of the upper handle section comprising at least two finger indentations adjacent the handle interior space.

5. The boot carrier according to claim 2, comprising two of the at least one carrier pins, the two carrier pins extending generally perpendicular to one other, a first, handle one of the carrier pins extending down from the base handle section, and a second, shank one of the carrier pins extending into the shank recess from one of the opposite longitudinal first sides of the shank.

6. The boot carrier according to claim 1, wherein the hanger portion is generally arrowhead-shaped, there being one of the at least two hook elements on each opposite first side of the boot carrier, a first one of the at least two hook elements on one first side of the boot carrier being a mirror image of a second one of the at least two hook elements on an opposite first side of the boot carrier.

7. The boot carrier according to claim 1, wherein a first one of the set of shoulder portions is on an outside wall of a central neck of the hanger portion, and a second one of the set of shoulder portions is on an inside wall of a free hook section of the hook element.

8. The boot carrier according to claim 5, wherein the shoulder portions of the set are mirror images of one another, each of the set of shoulder portions being molded into an opposite wall of the channel.

9. The boot carrier according to claim 1, wherein the boot carrier is one-piece, a longitudinal axis of the shank extending generally perpendicularly to a longitudinal axis of the handle portion, the shank being continuous with the handle portion above it and the hanger portion below it; and wherein the handle portion is in substantially the same plane as the hanger portion, each hook element extending up below one of the ends of the handle portion.

10. The boot carrier according to claim 1, wherein the shank is generally "H"-shaped in transverse cross section, the longitudinal first sides of the shank forming the sides of the "H"-shape and the floor forming the cross bar of the "H"-shape.

11. The boot carrier according to claim 1, wherein the hanger portion comprises: a) a narrow central hanger neck extending from the lower shank end; b) the at least two elongate hook elements, each of which forms a hook shape with the hanger neck; c) the channel lying between the hook element and the hanger neck; the hanger neck terminating in d) a lower, generally planar tip end of the hanger portion.

12. A reusable boot-sole guard carrier for carrying or storing at least one ski boot and at least one sole guard ski boot accessory, the boot-sole guard carrier comprising: (a) a handle portion; (b) a shank comprising two opposite longitudinal first sides, an upper shank end of the shank being attached to a base handle section of the handle portion; (c) a hanger portion attached to a lower, opposite end of the shank, the hanger portion comprising at least two elongate hook elements, each of the at least two hook elements comprising an open topped channel and at least one shoulder portion, on at least one wall of the channel within the hook element; the shank further comprising at least one shank recess between the opposite longitudinal first sides of the shank, and at least one carrier pin extending into the shank recess from a shank floor at a bottom of the shank recess; wherein a length of the shank plus a length of the hanger portion is about equal to a length of the handle portion.

13. The boot-sole guard carrier according to claim 12, comprising two of the at least one carrier pins, each of the carrier pins extending generally perpendicular to the other carrier pin, a first, handle one of the carrier pins extending down from the base handle section, and a second, shank one of the carrier pins extending into the shank recess from one of the opposite longitudinal first sides of the shank.

14. The boot-sole guard carrier according to claim 12, further comprising a sole guard outline on each opposite shank floor, and two of the at least one carrier pins attached to each of the opposite shank floors.

15. The boot-sole guard carrier according to claim 12, wherein each of two of the at least two hook elements comprises two opposite ones of the at least one shoulder portions, a first one of the shoulder portions being on an outside wall of a central neck of the hanger portion, and a second one of the shoulder portions being on an inside wall of a free hook section of the hook element.

16. The boot-sole guard carrier according to claim 15, wherein each of the at least two hook elements comprises one set of shoulder portions, each set of shoulder portions forming a pinched zone in the channel of the hook element.

17. The boot-sole guard carrier according to claim 12, wherein each of the at least two hook elements comprises one set of shoulder portions, each set of shoulder portions forming a pinched zone in the channel of the hook element; and wherein the shoulder portions of the set are mirror images of one another, each of the set of shoulder portions being molded into an opposite wall of the channel.

18. A combination boot carrier and carrier wall mount for carrying or storing a pair of ski boots, the combination boot carrier and wall mount comprising:

(a) a boot carrier comprising a handle portion, a shank, and a hanger portion; the carrier handle portion comprising an upper handle section, a base handle section, two mirror image handle ends, and a central interior space between the upper handle section and the base handle section, each of the two mirror image handle ends extending between an opposite end of the upper handle section and an opposite end of the base handle section, the upper handle section being substantially parallel to the generally horizontal base handle section; the carrier shank comprising two opposite sides, and an upper shank end attached to the base handle section; the carrier hanger portion being attached to a lower, opposite end of the shank, the hanger portion comprising at least two elongate hook elements, each of the at least two hook elements comprising an open topped channel and at least one shoulder portion along at least one wall of the channel within the hook element; and (b) a carrier wall mount comprising: at least one support peg, the at least one support peg comprising a peg base with a peg stop at one end of the peg base, an opposite end of the peg base being attached to a mounting bracket of the wall mount; wherein the handle portion of the boot carrier is removably hangable on the reusable wall mount.

19. The combination boot carrier and carrier wall mount according to claim 18, wherein the shank further comprises a shank recess between the opposite longitudinal first sides of the shank on each opposite, second side of the boot carrier, and at least two carrier pins, each extending into one of the shank recesses from a floor at a bottom of the shank recess.

20. The combination boot carrier and carrier wall mount according to claim 18, wherein two of the at least one support pegs are extendible under the base handle section or through the carrier handle space for supporting the boot carrier on the wall mount.

* * * * *